US007122285B2

(12) United States Patent
Kitani et al.

(10) Patent No.: US 7,122,285 B2
(45) Date of Patent: Oct. 17, 2006

(54) TONER FOR DEVELOPING STATIC LATENT IMAGE, METHOD FOR PRODUCING TONER FOR DEVELOPING STATIC LATENT IMAGE

(75) Inventors: Ryuji Kitani, Hino (JP); Asao Matsushima, Hachioji (JP); Tomoe Kitani, Hino (JP)

(73) Assignee: Konica Corporation, Tokyo (JP)

( * ) Notice: Subject to any disclaimer, the term of this patent is extended or adjusted under 35 U.S.C. 154(b) by 77 days.

(21) Appl. No.: 10/379,638

(22) Filed: Mar. 4, 2003

(65) Prior Publication Data

US 2003/0186150 A1 Oct. 2, 2003

(30) Foreign Application Priority Data

Mar. 7, 2002 (JP) ..... 2002-061822

(51) Int. Cl.
*G03G 9/08* (2006.01)

(52) U.S. Cl. ..... 430/108.5; 430/137.14

(58) Field of Classification Search ..... 430/108.3, 430/108.5, 137.14, 108.2
See application file for complete search history.

(56) References Cited

U.S. PATENT DOCUMENTS 2,297,691 A * 10/1942 Carlson ..... 430/55
4,396,697 A * 8/1983 Ciccarelli et al. ..... 430/108.2
5,202,209 A * 4/1993 Winnik et al. ..... 430/108.5
6,020,102 A * 2/2000 Fujimoto et al. ..... 430/108.21
6,743,559 B1 * 6/2004 Combes et al. ..... 430/137.14
2003/0134218 A1 * 7/2003 Bedells et al. ..... 430/137.14

OTHER PUBLICATIONS

Diamond, Arthur S. (ed.) Handbook of Imaging Materials. New York: Marcel-Dekker, Inc. (1991) p. 169.*

* cited by examiner

*Primary Examiner*—Christopher Rodee
(74) *Attorney, Agent, or Firm*—Squire Sanders & Dempsey

(57) ABSTRACT

A toner for developing a static latent image is disclosed. The colored resin particle contains a resin and a colorant, and the colored resin particle contains at least two kinds of compound each represented by the following Formula, and total amount is from 1 to 1,000 ppm by weight, wherein, R is an aliphatic hydrocarbon group having from 6 to 22 carbon atoms, M is a monovalent metal atom or an ammonium

20 Claims, 1 Drawing Sheet

TONER FOR DEVELOPING STATIC LATENT IMAGE, METHOD FOR PRODUCING TONER FOR DEVELOPING STATIC LATENT IMAGE

FIELD OF THE INVENTION

The invention relates to a toner for developing a static latent image, a method for producing the toner for developing the static latent image and a method for forming an image.

BACKGROUND OF THE INVENTION

The static latent image developing method represented by an electrophotographic method is widely applied as method forming means such as a printer, a copy machine and a facsimile machine.

Because the method is a highly accomplished method by which a high quality image can be stably obtained at a high speed. However, some problems are remained.

For example, in usual toner produced by a crushing method, the materials dispersed in the toner are not uniformly distributed at the broken surface and the surface properties of each toner particles are difficultly made the same. Therefore, fluctuation of toner transfer in the transfer process tens to be occurred so as to lower the color reproducibility in a color image.

The toner for developing static latent image is required to reduce the particle diameter for raising the image quality. Recently, the toner produced by a polymerization method is actively developed as the method for producing the toner having a small particle diameter. Examples of such the method include a method for producing a toner particle having an irregular shape by salting, coagulation or adhering by fusion of a resin particle and a colorant particle, and a method by which a radical polymerizable monomer and a colorant are dispersed in an aqueous medium so as to form a liquid droplet having the designated toner diameter and subjected to suspension polymerization.

The toner particle having a spherical shape and uniform surface property can be produced by the suspension polymerization method. Therefore, the uniformity of the toner particles is raised but the adhesiveness to the image carrier is made higher since the shape of the toner is sphere. Accordingly the transfer ability of the toner particle is lowered.

A non-spherical particle produced by a method is disclosed in Japanese Patent Publication Open to Public Inspection, hereinafter referred to as JP O.P.I. Publication, No. 11-194540, in which a resin particle is prepared by polymerized in an aqueous medium containing a surfactant and treated by a coagulating agent in a concentration more than the critical coagulation concentration of the resin particle and a water-miscible organic solvent.

In the foregoing technology, a toner excellent in high uniformity of the shape and the charging amount and high sharpness of the image can be obtained by the use of two- or three-valent metal salt. However, the craft point of the surfactant is raised by the presence of the two- or three-valent metal salt so as to form a precipitation difficultly soluble in water. The precipitation is remained in a state of adhered to the toner particle and tends to cause lowering of the fine line reproducibility and spreading of the character image.

SUMMARY OF THE INVENTION

The object of the invention is to provide a toner for developing a static latent image which forms a low fogged image and has a high transparency on an over head projector OHP, a producing method of such the toner and an image forming method.

The invention and its preferable embodiment are described.

A toner for developing a static latent image comprising a colored resin particle containing a resin and a colorant, wherein the colored resin particle contains at least two kinds of compound each represented by the following Formula, and total amount of the compound is from 1 to 1,000 ppm by weight based on the total amount of the colored resin particle,

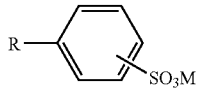

wherein, R is an aliphatic hydrocarbon group having from 6 to 22 carbon atoms, M is a monovalent metal atom or an ammonium ion.

The colored resin particle contains a first compound represented by the Formula from 50 to 90% by weight based on the whole amount of the compound represented by the Formula in the colored resin particle.

The colored resin particle contains the first compound represented by the Formula from 60 to 80% by weight of the whole amount of the compound represented by the Formula in the colored resin particle.

The colored resin particle contains a second compound and the difference of carbon atoms between the first and the second compound is 1.

The compound is selected from the group consisting of:

n-$C_8H_{17}$—($C_6H_4$)—$SO_3Na$ (p),
n-$C_9H_{19}$—($C_6H_4$)—$SO_3Na$(p),
n-$C_{11}H_{23}$—($C_6H_4$)—$SO_3Na$(p),
n-$C_{12}H_{25}$—($C_6H_4$)—$SO_3Na$(p),
n-$C_{13}H_{27}$—($C_6H_4$)—$SO_3Na$(p), $$CH_3-\underset{}{\overset{CH_3}{\overset{|}{CH}}}-C_9H_{18}-C_6H_4-SO_3Na(p) \text{ and}$$

$$CH_3-\overset{CH_3}{\overset{|}{CH}}-\overset{CH_3}{\overset{|}{CH}}-C_7H_{14}-C_6H_4-SO_3Na(p).$$

The colored resin particle contains a metal salt in an amount of from 250 to 20,000 ppm by weight.

The metal salt is a salt of sodium, potassium, lithium, calcium and magnesium, manganese, copper, iron or aluminum.

The metal salt is sodium chloride, potassium chloride, lithium chloride, calcium chloride, zinc chloride, cupric sulfate, magnesium sulfate, manganese sulfate, aluminum chloride or ferric chloride.

A method of producing the toner mentioned above, wherein the resin is prepared by polymerization of a polymerizable monomer in an aqueous medium.

A method of producing the toner mentioned above, wherein the colored resin particle is prepared by a process of coagulating and adhering by fusion of a resin particles and colorant particles in an aqueous medium.

The toner is preferably applied for an image forming method comprising the steps of for forming a static latent image; for forming a toner image by developing the static latent image; and for transferring the toner image onto an image receiving material.

DETAILED DESCRIPTION OF THE INVENTION

Figure 1:
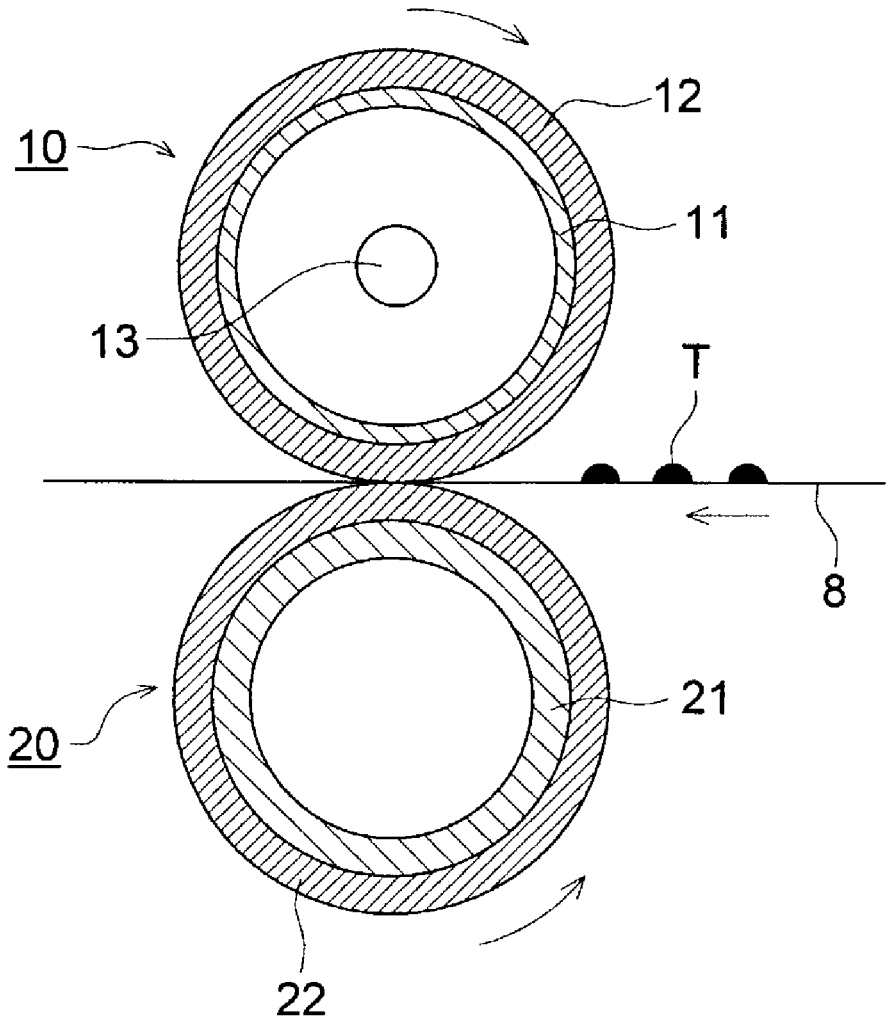
FIG. 1 shows the cross section of an example of the fixing device usable in the invention.

As a result of the investigation by the inventors, a toner for developing a static latent image improved in the fogging and the OHP transparency can be obtained by controlling the amount of the surfactant represented by Formula 1 so as to be from 1 to 1,000 ppm by weight in the toner for developing the static latent image produced by the process for fusion-adhering a resin particle and a colorant particle.

The toner according to the invention contains two or more kinds of compounds different from each other and each represented by Formula 1. The difference between the different compounds includes difference of the number of carbon atoms in the substituent R of each of the compound, difference in the number of bond of the carbon atom caused by branching or the presence of a double bond even when the carbon numbers of the substituents R of each of the compounds are the same, and difference in the substituent of the phenylene group or the position of the sulfonyl group of the compounds even when the R are the same. The colored resin particle containing the two or more compounds different from each other and each represented by Formula 1 has such the compounds at the interior or the surface of the particle. It has been found that the different compound shows a different charge holding ability at the interior and the surface of the resin particle, and the charge holding ability can be raised by containing of two or more kinds of the compound so as to inhibit the image defect. Moreover, it has been found that the fogging and the OHP transparency of image can be improved since the formation of the by-product with the metal element is inhibited by the use of the two or more compounds in combination. A preferable result can be obtained when the amount of one kind of the compound is from 50% to 90% by weight of the whole amount of the compounds represented by the Formula 1. The compound occupying highest content in the colored resin particles among the compound represented by the Formula 1 is called as "Compound A" and the compound occupying the second content "Compound B".

A combination of the compound slightly different in the carbon number of R gives a preferable result. The combination of compounds in which the difference of the carbon number is 1 is preferable.

The amount of one kind of the compound in the two or more compounds to be used is preferably from 60 to 80%, particularly preferably from 65 to 70%, by weight of the whole amount of the compounds.

(Compound Represented by Formula 1)

The compounds represented by Formula 1 can be used in the process for preparing the dispersion of the resin particle and that for fusion-adhering the resin particle and the colorant particle, and are finally distributed in the interior or on the surface of the colored resin particle after the production of the toner.

The compound represented by Formula 1 is described below.

In the Formula 1, R is an aliphatic carbon hydride group. An aliphatic carbon hydride group having from 6 to 22 carbon atoms is preferable, and that having from 8 to 20, particularly from 9 to 16, carbon atoms is further preferable.

Examples of the aliphatic carbon hydride group having 6 to 22 carbon atoms include, for example, an alkyl group such as an n-hexyl group, an n-heptyl group, an n-octyl group, an n-nonyl group, an n-decyl group, an n-undecyl group, a 2,3-dimetyldecyl group, an n-dodecyl group, an n-tridecyl group, an n-tetradecyl group, an n-pentadecyl group, an n-hexadecyl group, a 2-methylundecyl group, an n-heptadecyl group, an n-octadecyl group and an n-docosadecyl group; a unsaturated aliphatic carbon hydride group or an alkenyl group, an alkadienyl group, an alkatrienyl group and an alkapolyenyl group, such as a decenyl group, a dodecenyl group, a tridecenyl group, a pentadecenyl group, a 5-(3-pentenyl)-3,6,8-decatriene-1-inyl group, a 6-(1,3-pantadienyl)-2,4,7-docodecatriene-9-inyl group and a 6-(pentene-3-inyl)-2,4,7,9-undecatetraenyl group; and a cyclo-aliphatic carbon hydride group such as an octylhexyl group and a nonylhexyl group. These carbon hydride groups may be ones each having either a straight- or branched chain.

Formula 1 represents an aliphatic carbon hydride benzene sulfonate having an ortho-phenylene group, a meta-phenylene group or a para-phenylene group according to the bonding position of the sulfonyl group. Among the compounds, ones having the para-phenylene group are preferred.

The phenylene group may have either a substituent or not. As the substituent, an aliphatic carbon hydride group, for example, an alkyl group such as a methyl group, an ethyl group, a propyl group and a butyl group; and an alkenyl group such as a vinyl group, an allyl group, an iso-propenyl group, a pentenyl group and an octenyl group are cited. The alkyl group and alkenyl group each may have a substituent.

In Formula 1, the mono-valent metal atom represented by M includes sodium, potassium and lithium. Sodium is preferably used.

The concrete examples of the compound represented by Formula 1 are shown below.

1. n-$C_8H_{17}$—($C_6H_4$)—$SO_3Na$ (p)
2. n-$C_9H_{19}$—($C_6H_4$)—$SO_3Na$(p)
3. n-$C_{11}H_{23}$—($C_6H_4$)—$SO_3Na$(p)
4. n-$C_{12}H_{25}$—($C_6H_4$)—$SO_3Na$(p)
5. n-$C_{13}H_{27}$—($C_6H_4$)—$SO_3Na$(p)

6.

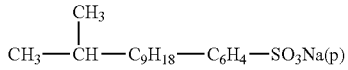

7.

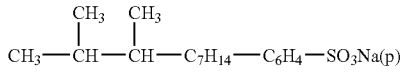

The toner for developing the static latent image contains the compounds represented by Formula 1 in an amount of from 1 to 1,000 ppm by weight. The amount is preferably from 5 to 500 ppm by weight, more preferably from 7 to 100 ppm by weight.

The compound is added during the preparation process of the toner, preferably during the polymerization process of the resin for colored resin particles. The compound may be dissolved in a monomer solution for polymerization.

As a means for controlling the content of the compound represented by Formula 1 so as to adjust to the foregoing amount, the following can be applied:

(a) Control of the latex, the amount of the colorant on the occasion of the dispersion (b) Control of the washing condition on the occasion of the preparation of the colored resin particle, and (c) Addition of the compound after the preparation of the toner or the developer.

The amount of the compounds can be controlled by the means suitably selected from the above items.

The effects of the invention can be obtained by addition of the specified amount of the compounds represented by Formula 1. Furthermore a secondary effect that the charging of the toner is uniformly given and stably held without influence of the environment can be obtained.

The amount of the compounds represented by Formula 1 contained in the toner can be determined by the following procedure.

One gram of the toner is dissolved in 50 ml of chloroform, and the compounds are extracted from the chloroform layer by 100 ml of ion-exchanged water. The extraction is once repeated by 100 ml of ion-exchanged water. Two hundreds milliliter of the extract or the water layer is diluted until 500 ml. The diluted solution is colored by methylene blue according to the method defined in JIS 33636 and the light absorbability is measured. And then the amount of the compounds is determined by referring a previously prepared calibration curve. Thereafter, the amount ratio of the each of the compounds is calculated base on the area ratio of the liquid chromatography.

The structure of the compound is decided by analysis of the foregoing extract by $^{1}$H-NMR.

In the invention, a metal salt is preferably used in the process for salting, coagulating and fusion-adhering the resin particles from the dispersion of the resin particles formed in the aqueous medium. The use of the two- or three-valent metal salt is preferable than the use of the mono-valent metal salt since the critical coagulation concentration (the coagulation value or the coagulation point) of the two- or three-valent metal salt is lower than that of the mono-valent metal salt.

Examples of the metal salt include a salt of a mono-valent metal such as sodium, potassium and lithium; a di-valent metal such as an alkali-earth metal, for example, calcium and magnesium, and a di-valent salt of manganese and copper; and a tri-valent metal such as iron and aluminum.

Concrete examples of the mono-valent metal salt include sodium chloride, potassium chloride and lithium chloride; that of the di-valent metal salt include calcium chloride, zinc chloride, cupric sulfate, magnesium sulfate and manganese sulfate; and that of the tri-valent metal salt include aluminum chloride and ferric chloride. These salts may be optionally selected according to the purpose.

In the invention, the critical coagulation concentration is an index of the stability of the dispersion in the aqueous dispersion liquid, and shows the concentration at which the coagulation is occurred. The critical coagulation concentration is varied depending on the property of the latex itself and the dispersing agent. The critical coagulation concentration is described in S. Okamura, "Kobunsi Kagaku" 17, 601 (1960), and the value of the critical coagulation concentration can be known by the description of that.

In another way, the salt to be measured is added into the particle dispersion in various concentrations and the ζ-potential of the dispersion is measured. The critical coagulation concentration of the salt can be decided according to the salt concentration at which the ζ-potential of the dispersion begins to vary.

In the invention, the polymer particle dispersion is treated using the metal salt so that the concentration of the metal salt is exceeded to the critical coagulation concentration. At this time, it is optionally selected according to the purpose that the metal salt is added directly or in a form of an aqueous solution. When the aqueous solution is used, it is necessary that the concentration of the salt in the dispersion is made so as to be larger than the critical coagulation concentration of the polymer particles.

The concentration of the metal salt as the coagulant in the invention is added to the dispersion so that the concentration thereof is become larger than the critical coagulation concentration, preferably 1.2 times or more, more preferably 1.5 times or more, of the critical coagulation concentration.

Temperature of the dispersion of the composite resin particles at a time the coagulant being added is lower than the glass transition temperature (Tg) of the composite resin particles, for example, from 5 to 55° C. in general and preferably from 10 to 45° C., in view of easy control of particle size.

It is preferable that the coagulant is added to the dispersion with stirring when its temperature being lower than the Tg of the composite particles and after that the dispersion is rapidly heated to reach temperature higher than the Tg.

Further, in the present invention, after preparing colored resin particles upon salting out, aggregating, and coalescing resin particles and colorants in a water based medium, separation of said colored resin particles from said water based medium is preferably carried out at a temperature of not lower than the Krafft point of the surface active agents in said water based medium, and is more preferably carried out in the range of said Krafft point to said Karfft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of minimizing excessive static charge to colored resin particles and providing uniform static-charge buildup to said colored resin particles, particularly in order to stabilize static-charge buildup against ambience, as well as to maintain the resulting static-charge buildup, the electrostatic image developing toner of the present invention preferably comprises the aforesaid metal elements (listed as such forms are metals and metal ions) in an amount of 250 to 20,000 ppm by weight in said toner and more preferably in an amount of 500 to 5,000 ppm by weight.

Further, in the present invention, the total concentration of divalent (or trivalent) metal elements employed in coagulants and univalent metal elements added as coagulation inhibiting agents, described below, is preferably from 350 to 35,000 ppm by weight.

It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

A composite resin particle is employed as a resin particle. The composite resin particle comprises a core resin particle and one or more layers covering the core resin particle having different molecular weight and/or composition from that of the core resin particle.

The core part is the core resin particle composing the composite resin particle.

The outermost layer is the outermost layer among the covering layers composing the composite resin particle.

The inter layer is a covering layer formed between the core and the outermost layer.

Molecular weight distribution of the composite resin particle is not monodisperse and has molecular weight gradient from the core to the outermost layer.

A multi-step polymerization method is preferably employed to obtain the composite resin particle in view of satisfactory regulation of molecular weight distribution, so as to obtain fixing strength and anti-offset characteristics. The multiple polymerization is a method in which a monomer composition is polymerized in the presence of a resin particle to form a resin layer having different molecular weight and/or composition from that of the resin particle on the surface of the resin particle. A plurality of covering layer is formed by repeating the polymerization.

A resin core particle is covered by a resin layer in the two-step polymerization, and one more layer is formed on the surface thereof in the three-step polymerization.

Uniform fine particles are obtained by the multi-step polymerization though each of the composite resin particles is composed of a plurality of resins having different molecular weight and/or composition. The colored resin particle obtained by subjecting the composite resin particles to salting-out, coagulation and fusion has very small variation in composition, molecular weight and surface characteristics.

Characteristics of off-set and winding to fixing roll are improved by employing the toner composed of the composite resin particle prepared by a multi-step polymerization with maintaining good adhesion characteristics of toner to paper sheet, since the each colored resin particle has uniform composition, molecular weight and surface characteristics.

The preferable production process preferably comprises the following processes:

(1) Multi-step polymerization which prepare composite resin particles.
(2) Salting out, coagulation and fusion process in which composite resin particles and colorant particles are subjected to salting out, coagulation and fusion to obtain colored resin particles.
(3) Filtration and washing process in which colored resin particles are separated from the dispersion and the colored resin particles are washed out to remove a surfactant etc.
(4) Drying process in which the washed colored resin particles are subjected to drying.
(5) Addition process of external additive to the colored resin particles.

Each step is described.

(I) Multi-Step Polymerization Process

The multi-step polymerization process is a process for preparing the composite resin particle by forming a covering layer composed of a resin made from monomers on a resin particle. It is preferred from the viewpoint of the stabile formation of cell structure of the obtained toner and the anti-crush strength to apply the multi-step polymerization including three or more polymerization steps.

The two- and tree-step polymerization methods, which are representative examples, are described below.

(Two-Step Polymerization Method)

The two-step polymerization method is a method for producing the composite resin particle comprised of the central portion (core) comprising the high molecular weight resin and an outer layer (shell) comprising the low molecular weight resin.

In concrete, a monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles. A functional material such as a releasing agent may be incorporated in the high-molecular weight component which forms core portion.

Next, a polymerization initiator and a monomer to form the lower molecular weight resin is added to the suspension of the resin articles, and the monomer is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the functional material such as crystalline material can be finely and uniformly dispersed by applying a procedure, at the time of forming the inter layer on the resin particle.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and so on which do not dissolve resins.

A method suitable for forming a resin particle or cover layer containing a functional material such as a releasing agent is preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the functional material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "Clearmix", ultrasonic homogenizers, mechanical homogenizers and Manton-Gaulin homogenizers and pressure type homogenizers.

The diameter of dispersed particles is 10 to 1,000 nm, and is preferably 50 to 1,000 nm and particularly preferably 30 to 300 nm.

The particle diameter of composite particles obtained by the process (1) is preferably from 10 to 1,000 nm in terms of weight average diameter determined employing an electrophoresis light scattering photometer "ELS-800" (produced by OTSUKA ELECTRONICS CO., LTD.).

Glass transition temperature (Tg) of the composite resin particles is preferably from 48 to 74° C., and more preferably from 52 to 64° C. The Softening point of the composite resin particles is preferably from 95 to 140° C. Salting out, Coagulation and Fusion In the process of salting out, coagulation and fusion composite resin particles obtained by multi-step polymerization and colorant particles are subjected to salting out, coagulation and fusion wherein salting out and fusion are caused simultaneously, to obtain aspherical colored resin particles.

Particles of additives incorporated within colored resin particles such as a charge control agent (particles having average diameter from 10 to 1,000 nm) may be added as well as the resin particles and the colorant particles in the salting-out/fusion process. Surface of the colorant particles may be modified by a surface modifier.

The colorant particles are subjected to salting out/fusion process in a state that they are dispersed in water based medium. The water based medium to disperse the colorant particles includes an aqueous solution dissolving a surfactant in concentration not less than critical micelle concentration (CMC).

The surfactant mentioned above which employed in the multi-step polymerization process can be employed in the process.

Homogenizers employed in the dispersion of the colorant particles include, for example, "Clearmix", ultrasonic homogenizers, mechanical homogenizers, and Manton-Gaulin homogenizers and pressure type homogenizers.

In order to carry out salting-out and fusion, it is required that salting agent (coagulant) is added to the dispersion of resin particles and colorant particles in an amount not less than critical micelle concentration and they are heated to a temperature of the glass transition temperature (Tg) or higher of the resin particles.

Coagulation terminator is employed when the particle diameter of the composite particles reaches predetermined value, more preferably. Example of the coagulation terminator is a monovalent metal salt, preferably sodium chloride.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Coagulants employed in the process of salting-out, coagulation and fusion process includes alkali metal salts and alkali earth metal salt mentioned above.

Salting-out/fusion process is that the processes of salting-out (coagulation of fine particles) and fusion (distinction of surface between the fine particles) occur simultaneously, or the processes of salting-out and fusion are induced simultaneously.

In order to simultaneously carry out salting-out and fusion, it is required that salting agent (coagulant) is added to the dispersion of resin particles and colorant particles in an amount not less than critical micelle concentration and they are heated to a temperature of the glass transition temperature (Tg) or higher of the resin particles.

The toner according to the invention is preferably produced by the following procedure, in which the compound resin particle is formed in the presence of no colorant, a dispersion of the colorant particles is added to the dispersion of the compound resin particles and the compound resin particles and the colorant particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the colored resin particle since the polymerization reaction for forming the compound resin particle is completely performed. Consequently, any offensive odor is not occurred in the fixing process by heating in the image forming method using such the toner.

The surface property of thus produced colored resin particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

A releasing agent can be employed in the toner of the invention. The releasing agent is incorporated in the colored resin particles in an amount of 1–30% by weight, more preferably 2–20% by weight and particularly preferably 3–15% by weight.

Preferable examples of the crystalline material having releasing property include low molecular weight polypropylene having average molecular weight of 1,500 to 9,000 and low molecular weight polyethylene, and a particularly preferable example is an ester compounds represented by Formula described below.

$$R^1—(OCO—R^2)_n$$

wherein n represent an integer of 1 to 4, and preferably 2 to 4, more preferably 3 or 4, and in particular preferably 4.

$R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26. Example of the compounds are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5)

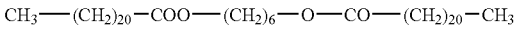

6)

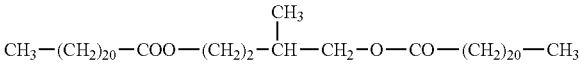

7)

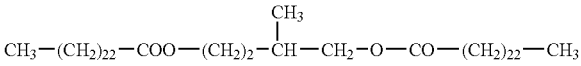

8)

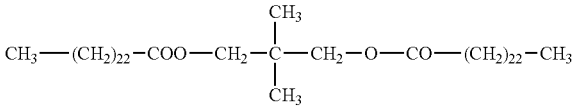

9)

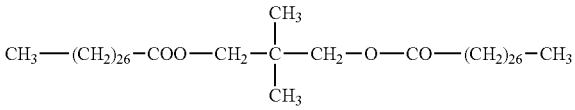

10)

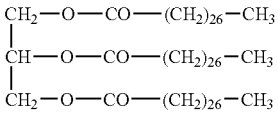

11)

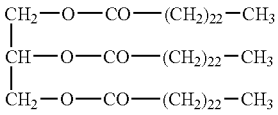

-continued

12)

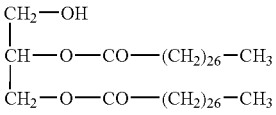

13)

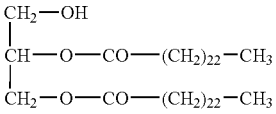

14)

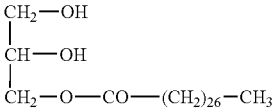

15)

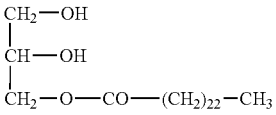

16)

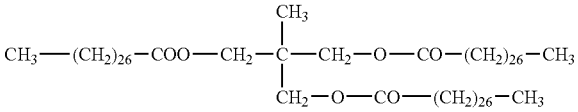

17)

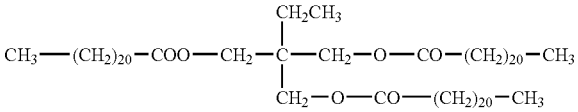

18)

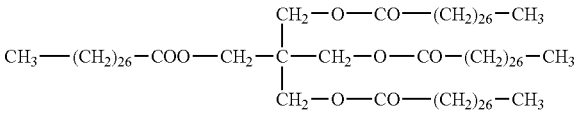

19)

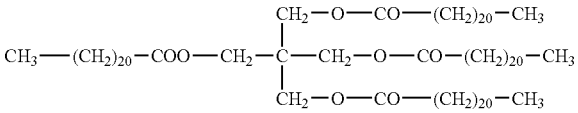

20)

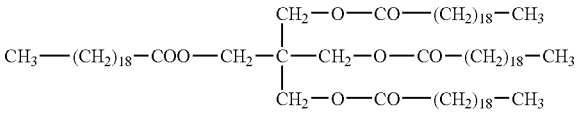

21)

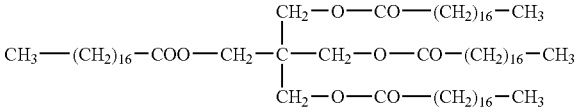

The releasing agent is employed in the toner in an amount of 1–30% by weight, preferably 2–20% by weight, and more preferably 3–15% by weight.

Molecular weight, molecular weight distribution, peak molecular weight etc., of the resin particle composing the toner is described.

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resin particles preferably comprise a high molecular weight resin having a peak or a shoulder within the range of from 100,000 to 1,000,000, and a low molecular weight resin having a peak or a shoulder within the range of from 1,000 to 50,000. More preferably the resin particles further comprise a middle molecular weight resin having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like.

Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

Filtration and washing process are described.

In the filtration and washing process, filtration is carried out in which said colored resin particles are collected from the colored resin particle dispersion, and washing is also carried out in which additives such as surface active agents, salting-out agents, and the like, are removed from the collected colored resin particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

The drying process is one in which said washed colored resin particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried colored resin particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) include acrylic acid, methacrylic acid, fumaric acid, maleic acid, itaconic acid, cinnamic acid, maleic acid mono-butyl ester, maleic acid mono-octyl ester and their sodium salts, zinc salts, etc.

Examples of said α,β-ethylenically unsaturated compound containing the sulfonic acid group (—$SO_3H$) include sulfonated styrene and its sodium salt, allylsulfo succinic acid, allylsulfo succinic acid octyl ester and their sodium salts.

The polymerization initiator is described.

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

The chain transfer agent is described.

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservavability, fixing strength, anti-off-set and so on.

The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group.

Among them n-octyl-3-mercaptopropionic acid ester is preferable in view of minimizing smell at the time of thermal fixing.

The colorant employed in a colored resin particles is described.

The colorant is preferably incorporated in the colored resin particles by such a way that the colorant is subjected to salting-out, coagulation and fusion along with the composite resin particles in the colored resin particle preparing process in view of the uniform charge characteristics of the toner.

Listed as colorants which constitute the toner of the present invention may be inorganic pigments, organic pigments, and dyes.

Employed as said inorganic pigments may be those conventionally known in the art. Specific inorganic pigments are listed. Employed as black pigments are, for example, carbon black such as furnace black, channel black, acetylene black, thermal black, lamp black, and the like, and in addition, magnetic powders such as magnetite, ferrite, and the like.

These inorganic pigments may be employed individually or in combination of a plurality of these. Further, the amount of the pigments is usually between 2 and 20 percent by weight with respect to the polymer, and is preferably between 3 and 15 percent by weight.

The magnetite can be employed when the toner is employed as a single component toner. In this instance incorporate amount is preferably 20 to 60% by weight of toner in view of giving predetermined magnetic characteristics.

Various organic pigments and dyes may be employed. The colorant in wet paste state is effectively employed to demonstrate the effect of the invention as stated above. Practical organic pigments are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 156, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, C.I. Solvent Red 59, C.I. Solvent Red 52, C.I. Solvent Red 58, C.I. Solvent Red 63, C.I. Solvent Red 111, C.I. Solvent Red 122; C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, Solvent Yellow 162; C.I. Solvent Blue 25, C.I. Solvent Blue 36, C.I. Solvent Blue 60, C.I. Solvent Blue 70, C.I. Solvent Blue 93, and C.I. Solvent Blue 95. Further these may be employed in combination.

These organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "P PLENACT" TTS, 9S, 38S, 41B, 46B, 55, 138S, 238S etc., by Ajinomoto-Fine-Techno Co., Inc., A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "PLENACT AL-M" by Ajinomoto-Fine-Techno Co., Inc.

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

An additive other than a coloring agent such as a releasing agent or a charge controlling agent may be incorporated in the colored resin particles.

Various kinds of charge controlling agent can be used; for example, a Nigrosine dye, a metal salt of naphthenic acid, or higher fatty acid, alkoxyamine, a quaternary ammonium salt compound, azo metallic complex, a metallic salt of salicilic acid or its metallic complex, etc. can be cited.

External additives may be employed in the toner of the invention. Various kinds of inorganic fine particles, organic fine particles, and a smoothing agent can be used for the purpose of improving fluidity or raising the cleaning performance. An inorganic fine particles of silica, titania, aluminum, etc. can be desirably used. For these fine particles, hydrophobic ones are desirable.

To state it concretely, as for the silica fine particles, for example, products on the market produced by Nihon Aerosil Co., Ltd. R-805, R-976, R-974, R-972, R-812, and R-809, products produced by Hoechst GmbH HVK-2150 and H-200, products on the market produced by Cabot Corp. TS-720, TS-530, TS-610, H-5, and MS-5, etc. can be cited.

For the titania fine particles, for example, products on the market produced by Nihon Aerosil Co., Ltd. T-805 and T-604, products on the market produced by TAYCA Corp. MT-100S, MT-100B, MT-500BS, MT-600, MT-600SS, and JA-1, products on the market produced by Fuji Titanium Industry Corp. TA-300SI, TA-500, TAF-130, TAF-510, and TAF-510T, products on the market produced by Idemitsu Kosan Co., Ltd. IT-S, IT-OA, IT-OB, and IT-OC, etc. can be cited.

For the alumina fine particles, for example, products on the market produced by Nihon Aerosil Co., Ltd. RFY-C and C-604, a product on the market produced by Ishihara Sangyo Kaisha, Ltd. TO-55, etc. can be cited.

For the organic fine particles, it is possible to use spherical organic fine particles having a number-average primary particle diameter of about 10 to 2000 nm. To state it concretely, fine particles of a homopolymer of styrene, methyl methacrylate, etc. or a copolymer of these can be used.

As regards the lubricant, for example, metallic salts of higher fatty acids such as stearic acid salts of metals such as zinc, aluminum, copper, magnesium, and calcium, oleic acid salts of metals such as zinc, manganese, iron, copper, and magnesium, palmitic acid salts of metals such as zinc, copper, magnesium, and calcium, linoleic acid salts of metals such as zinc and calcium, and ricinoleic acid salts of metals such as zinc and calcium can be cited.

These external additives may be added preferably in an amount of about 0.01 to 5% by weight to the toner.

The external additives are added to dried colored resin particles.

Listed as devices which are employed for the addition of external additives, may be various types of mixing devices known in the art, such as tubular mixers, Henschel mixers, Nauter mixers, V-type mixers, and the like.

Herein, the colored resin particle diameter of the present invention is 3 to 10 μm, more preferably 3 to 8 μm in terms of the volume average particle diameter. The particle diameter can be regulated by controlling the concentration of coagulant, amount of the organic solvent, time during fusion, composition of resin etc.

The toner having such average particle diameter is preferable as image quality of fine line or dot is improved because large particles which causes flying and adhering to a heating device and generates off set are minimized and transfer efficiency is improved.

It is possible to determine said volume average particle diameter of colored resin particles, employing a Coulter Counter TA-II, a Coulter Multisizer, SLAD 1100 (a laser diffraction type particle diameter measuring apparatus, produced by Shimadzu Seisakusho), and the like.

Herein values are shown which are obtained based on the particle diameter distribution in the range of 2.0 to 40 μm, employing an aperture having an aperture diameter of 100 μm of said Coulter Counter TA-II as well as said Coulter Multisizer.

The shape factor of the toner of the present invention is represented by the formula described below and shows the degree of circularity of a colored resin particle.

$$\text{Shape factor} = \{(\text{maximum diameter}/2)^2 \times \pi\}/\text{projected area}$$

The maximum diameter, as described herein, refers to the width of a particle so that when the projected image of a colored resin particle onto a plane is interposed by two parallel lines, the distance between said two parallel lines is maximal. Further, the projected area, as described herein, refers to the area of the image of a colored resin particle projected onto a plane.

In the present invention, said shape factor was determined as follows. Colored resin particles were enlarged by a factor of 2,000, employing a scanning type electron microscope and then photographed. Subsequently, the resulting photograph was subjected to photographic image analysis, employing a "Scanning Image Analyzer" (manufactured by JEOL Ltd.), so as to determine the shape factor. In such a case, 1,000 colored resin particles were employed and the shape factor of the present invention was determined employing the aforesaid calculation formula.

In the toner of the present invention, it is preferable that the ratio of colored resin particles, having a shape factor in the range of 1.0 to 1.6, is at least 65 percent, more preferably 70 percent by number with respect to the number of all colored resin particles, and further it is preferable that the ratio of colored resin particles, having a shape factor in the range of 1.2 to 1.6, is at least 65 percent, more preferably 70 percent by number with respect to the number of all colored resin particles.

The colored resin particles satisfying the condition mentioned above have uniform triboelectric charging characteristics against to developer conveying device etc., without accumulating colored resin particles having excess charge, and the toner is easily replaced from the front of the toner conveying device, and therefore such a problem as developing ghost is minimized. Further, charging characteristics of toner is stabilized since the colored resin particles becomes difficult to crush and stain on the charging device is reduced.

Methods to control the shape characteristics of the present invention are not particularly limited. For example, employed may be a method in which colored resin particles are classified employing forced air. However, in order to further decrease the number variation coefficient, classification in liquid is also effective. In said method, by which classification is carried out in a liquid, is one employing a centrifuge so that colored resin particles are classified in accordance with differences in sedimentation velocity due to differences in the diameter of colored resin particles, while controlling the frequency of rotation.

The polymerized toner, which is preferably employed in the present invention, is as follows. The diameter of colored resin particles is designated as D (in μm). In a number based histogram, in which natural logarithm ln D is taken as the abscissa and said abscissa is divided into a plurality of classes at an interval of 0.23, a toner is preferred, which exhibits at least 70 percent of the sum (M) of the relative frequency ($m_1$) of colored resin particles included in the highest frequency class, and the relative frequency ($m_2$) of colored resin particles included in the second highest frequency class.

By adjusting the sum (M) of the relative frequency ($m_1$) and the relative frequency ($m_2$) to at least 70 percent, the dispersion of the resultant colored resin particle size distribution narrows. Thus, by employing said toner in an image forming process, it is possible to securely minimize the generation of selective development.

In the present invention, the histogram, which shows said number based particle size distribution, is one in which natural logarithm ln D (wherein D represents the diameter of each colored resin particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 mg of a sample to be measured is added to the resultant mixture. Preparation is then carried out by dispersing the resultant mixture for one minute employing an ultrasonic homogenizer.

The toner of the invention can be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 μm are incorporated into colored resin particles and employed as a magnetic single component developer.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 μm, and more preferably have one between 25 to 80 μm.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

The toner of the present invention is preferably employed in an image forming method (being the image forming method of the present invention) comprising a fixing process utilizing a specific fixing unit.

FIG. 1 is a cross-sectional view showing one example of the fixing unit employed in the present invention. The fixing unit shown in FIG. 1 is comprised of heating roller 10 and pressure roller 20, being in contact with said heating roller 10. In FIG. 1, T is a toner image formed on a paper transfer sheet.

Heating roller 10 is comprised of core metal 11 having thereon cover layer 12 comprised of a fluorine based resin, and includes heating member 13 comprised of a linear heater.

Said metal core 11 is comprised of metal selected from aluminum, iron, and copper, or alloys thereof. Its inner diameter is between 10 and 70 mm.

The wall thickness of said metal core 11 is to be between 0.1 and 15 mm, and is determined to achieve a balance between the demand for energy saving (a decrease in thickness) and the strength (dependent on composition of the structured materials). For example, when a 0.57 mm thick metal core comprised of iron is replaced with one comprised of aluminum, in order to retain the same strength, it is necessary to increase the wall thickness to 0.8 mm.

Exemplified as fluorine based resins composing cover layer 12 are PTFE (polytetrafluoroethylene), PFA (tertafluoroethylene-perfluoroalkyl vinyl ether copolymers), and the like.

The thickness of cover layer 12 is between 10 and 500 μm, and preferably 20 to 400 μm.

The elastic material forming a covering layer 12 includes silicone rubber or silicone sponge, which has good heat resistance, such as LTV, RTV and HTV.

An Asker C harness of the elastic material covering layer 12 is less than 80 degrees, preferably less than 60 degrees.

The thickness of the elastic material covering layer 12 is 0.1 to 30 mm, and preferably 0.1 to 20 mm.

When the Asker C hardness of elastic materials constituting covering layer 12 exceeds 80 degrees, as well as when the thickness of the covering layer is less than 0.1 mm, it is impossible to increase the fixing nip. Accordingly it is impossible to exhibit effects of soft fixing (for example, improvement of color reproduction by toner layer at a leveled interface).

Halogen heaters may be suitably employed as heating member 13.

Pressure roller 20 comprises cylinder 21 having on its surface covering layer 22 comprised of elastic materials. Elastic materials constituting covering layer 22 are not particularly limited, and may include various types of soft rubber such as urethane rubber, silicone rubber, and the like, and also foamed rubber. Silicone rubber as well as silicone sponge rubber is preferably employed, which is exemplified as those constituting covering layer 12.

The Asker C hardness of elastic materials, constituting covering layer 22, is commonly less than 80 degrees, is preferably less than 70 degrees, and is more preferably less than 60 degrees.

The thickness of covering layer 22 is commonly 0.1 to 30 mm, and is preferably 0.1 to 20 mm.

Materials constituting cylinder 21 are not particularly limited, and may include metals such as aluminum, iron, copper, and the like, and alloys thereof.

The contact load (total load) of heating roller 10 applied to pressure roller 20 is commonly 40 to 350 N, is preferably 50 to 300 N, and is more preferably 50 to 250 N. Said load is set taking into the strength (the wall thickness of cylinder 11) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 1 is employed, an example of fixing conditions are as follows: fixing temperature (surface temperature of heating roller 10) is 150 to 210° C., and fixing linear speed is 80 to 640 mm/second.

A fixing unit may be provided with said cleaning mechanism. Employed as cleaning systems are a system in which various types of silicone oil are supplied to a fixing film, or a system which carries out cleaning, employing a pad impregnated with silicone oil, a roller, a web and the like.

Silicone oil having high resistance to heat, for example, polydimethylsilicone, polymethylphenylsilicone etc. are employed. The silicone oil having a viscosity of 10 Pa·s at 20° C. is preferably employed because those having low viscosity is provided in excess.

Specifically, the present invention exhibits marked effects for a system in which none or a definite amount of silicone oil is used. Therefore, it is preferable to provide not more than 2 mg/A4 size sheet in case the oil is employed.

An amount of the silicone oil adhered to an image forming sheet. is reduced by suppressing not more than 2 mg/A4 size sheet, and as the result, it does not hinder to write the sheet by oily pen such as ball pen.

Further deterioration of off-set resistance due to denature of silicone oil according to time lapsing, contamination of optical system or charging electrodes by silicone oil can be avoided.

The providing amount of silicone oil is calculated by measuring the mass difference of fixing device ($\Delta w$) before and after putting 100 sheets of A4 size sheet through rollers of the fixing device continuously ($\Delta w/100$).

EXAMPLES

The invention is described referring examples in detail below.

Example 1

Latex 1HLM, Latex 2L (used for shell formation) and a colorant dispersion were prepared as follows, and Colored resin particle 1 was produced using them.

(Preparation of Latex)

Preparation of Latex 1HML

1. Preparation of Latex 1H (the First Step of Polymerization: Preparation of Nuclear Particle)

A surfactant solution as an aqueous medium composed of 4 g of Exemplified Compound 1, 1 g of Exemplified Compound 2 and 3,000 g of ion-changed water was charged into a separable flask of 5,000 ml on which a stirring device, a temperature sensor, a cooler and a nitrogen gas introducing device are attached. The temperature of the contents of the flask was raised by 80° C. while stirring at a speed of 230 rpm under nitrogen gas stream.

Into the surfactant solution, a polymerization initiator solution composed of 10 g of a polymerization initiator, potassium per sulfate KPS, and 400 g of ion-exchanged water was added and the temperature of the mixture was adjusted to 75° C. And then a monomer mixture liquid composed of 560 g of styrene, 200 g of n-butyl acrylate and 40 g of methacrylic acid was dropped spending 1 hour. This system was heated and stirred at 75° C. for 2 hours so as to perform polymerization (the first step polymerization). Thus latex or a dispersion of high molecular weight resin particles was prepared; the latex was referred to as Latex 1H.

2. Preparation of Latex 1HM (the Second Step of Polymerization: Formation of an Inter Layer)

In a flask with a stirring device, a monomer mixture liquid composed of 95 g of styrene, 36 g of n-butyl acrylate, 9 g of methacrylic acid and 0.59 g of n-octyl 3-mercaptopropionate was charged and 77 g of the compound represented by the foregoing formula 19, hereinafter referred to as Exemplified Compound 19 was added as the mould releasing agent. The mixture was heated by 90° C. for dissolving the mould releasing agent.

A surfactant solution composed of 8 g of Exemplified Compound 1 and 2 g of Exemplified Compound 2 each represented by Formula 1 and 1560 ml of ion-exchanged water was heated by 98° C. To the surfactant solution, 28 g, in terms of the solid ingredients, of the dispersion of nuclear particles Latex 1H was added. In thus obtained solution, the forgoing monomer liquid containing Exemplified Compound 19 was mixed and dispersed for 8 hours by a mechanical dispersing apparatus having a circling channel Clearmix manufactured by M-Technique Co., Ltd. Thus a dispersion (emulsion) containing emulsified particles or oil droplets having a particle diameter of 284 nm was prepared.

Then to the dispersion (emulsion), a polymerization initiator solution composed of 5 g of the polymerization initiator KPS and 200 ml of ion-exchanged water was added. This system was heated and stirred at 98° C. for 12 hours so as to perform polymerization (the second step polymerization). Thus latex or a dispersion of complex resin particles, which is comprised of high molecular weight resin particles each covered with the medium molecular weight resin, was prepared; the latex was referred to as Latex 1HM.

A particle having a particle diameter of from 400 to 1.000 nm principally constituted by Exemplified Compound 19 which was not surrounded by the latex, was observed when Latex 1HM was dried and observed by a scanning electron microscope.

3. Preparation of Latex 1HML (the Third Step of Polymerization: Formation of the Outer Layer)

An initiator solution composed of 6.8 g of the polymerization initiator KPS and 265 ml of ion-exchanged water was added to the above-obtained Latex 1HM. To thus obtained dispersion, a monomer mixture liquid composed of 249 g of styrene, 88.2 g of n-butyl acrylate, 24.3 g of methacrylic acid and 7.45 g of n-octyl 3-methylmercatopropionate was dropped spending for 1 hour at a temperature of 80° C. After the completion of the dropping, polymerization (the third step of polymerization) was performed for 2 hours while heating and stirring. Then the suspension was cooled by 28° C. Thus a latex was obtained, which is a dispersion of resin particles each having the core of the high molecular weight resin, the interlayer of the medium molecular weight resin containing Exemplified Compound 19 and the outer layer of the low molecular weight resin. The latex was referred to as Latex 1HML.

The complex resin particle constituting Latex 1HML had peaks of molecular weight at 139,000, 80,000 and 13,000, and the weight average diameter of the complex resin particle was 122 nm.

Preparation of 2L: Used for Shell Formation

A surfactant solution as an aqueous medium composed of 3.2 g of Exemplified Compound 1, 0.8 g of Exemplified Compound 2 and 3,000 g of ion-changed water was charged into a separable flask of 5,000 ml on which a stirring device, a temperature sensor, a cooler and a nitrogen gas introducing device are attached. The temperature of the contents of the flask was raised by 80° C. while stirring at a speed of 230 rpm under nitrogen gas stream.

To the surfactant solution, a polymerization initiator solution composed of 10 g of the polymerization initiator, potassium persulfate KPS, and 400 g ion-exchanged water was added and heated by 75° C. The a monomer mixture liquid composed of 560 g of styrene, 200 g of n-butyl acrylate, 40 g of acrylic acid and 25 g of n-octyl 3-mercaptopropionate was dropped into the surfactant solution and heated and stirred for 2 hours at 75° C. to perform polymerization. Thus obtained dispersion was referred to as Latex 2L (Preparation of Colorant)

In 1,600 ml of ion-exchanged water, 78 g of Exemplified Compound 1 and 19 g of Exemplified Compound 2 were dissolved by stirring, and then 420.0 g of C.I. Pigment red 122 was gradually added while stirring. Thereafter, the pigment was dispersed by a stirring machine Clearmix manufactured by M-Technique Co., Ltd. Thus a dispersion of colorant particles, hereinafter referred to as Colorant Dispersion 1, was prepared. The particle diameter of the colorant particle was 110 nm which was measured by an electrophoresis light scattering photometer ELS 800, manufactured by Ootsuka Denshi Co., Ltd.

(Preparation of Colored Resin Particle 1)

Coagulation, fusion-adhesion and association of the complex resin particles in Latex 1HML and the Colorant particles Into a reaction vessel or a four mouth flask to which a thermo sensor, cooler, nitrogen gas introducing device and stirring device were attached, 420.7 g of Latex 1HML in terms of solid ingredients, 900 g of ion-exchanged water and Colorant Dispersion 1 were charged and stirred. The temperature of the contents of the flask was adjusted to 30° C. Then 5 moles per liter aqueous solution of sodium hydroxide was added so as to make the pH value of from 8 to 11.0.

Thereafter, a solution composed of 20.0 g of magnesium chloride hexahydrate and 1,000 ml of ion-exchanged water was added to the above-obtained dispersion spending 10 minutes at 30° C. while stirring. After standing for 3 minutes, the system was heated so that the temperature is attained at 90° C. spending 60 minutes. The particle size of the associated particle was measured by Coulter Counter TA-II in such the status and a solution composed of 40.2 g of sodium chloride and 1,000 of ion-exchanged water was added at the time at which the number average particle diameter were attained at 4 to 7 μm to stop the growing of the particle. The heating and stirring were further continued 6 hours at 98° C. as a ripening treatment for continuing the fusion-adhering of the particles.

Shell Forming Procedure

After the above-described treatment of the coagulation, fusion-adhering and association, 96 g of Latex 2L or the dispersion of the resin particles, was added to the system and heating and stirring were continued for 3 hours so that the Latex 2L was fusion-adhered onto the associated particle of Latex 1HML. Then 40.2 g of sodium chloride was added and the system was cooled by 30° C. in a rate of 8° C., and the pH was adjusted to 2.0 by the addition of hydrochloric acid, and the stirring was stopped. Thus produced salted, coagulated and fusion-adhered particles were filtered and washed by using ion-exchanged water at 45° C. in an amount of 100 times of the solid composition of the colorant particles. After washing, filter cake was dried at 40° C. by warmed air to obtain Colored resin particle 1.

(Preparation of Colored Resin Particles 2–10)

Colored resin particles 2–10 were prepared in the same manner as in Colored resin particle 1 except that Exemplified Compounds 1 and 2 used in the preparation of Latex 1H, Latex 1HM and Latex 2L and used for dispersing the colorant were changed as described in Table 1. The compound occupying highest content in the colored resin particle is called as "Compound A", and the compound occupying second highest content "Compound B" in Table 2.

TABLE 1

| | Exemplified Compound No. and added amount | | | | | |
|---|---|---|---|---|---|---|
| Toner No. | In Core (1H) | In Inter Layer (1HM) | In Shell (2L) | In Colorant Dispersion | Coagulant $MgCl_{12}$ | Terminator NaCl |
| 1 | 1: 4.0 g<br>2: 1.0 g | 1: 8.0 g<br>2: 2.0 g | 1: 3.2 g<br>2: 0.8 g | 1: 78 g<br>2: 19 g | 20.0 g | 40.2 g |
| 2 | 2: 2.6 g<br>3: 2.4 g | 2: 2.6 g<br>3: 2.4 g | 2: 2.1 g<br>3: 1.9 g | 2: 51 g<br>3: 46 g | 10.0 g | 40.2 g |

TABLE 1-continued

| Toner No. | Exemplified Compound No. and added amount: In Core (1H) | In Inter Layer (1HM) | In Shell (2L) | In Colorant Dispersion | Coagulant $MgCl_{12}$ | Terminator NaCl |
|---|---|---|---|---|---|---|
| 3 | 4: 2.4 g<br>3: 1.6 g | 4: 0.6 g<br>3: 0.4 g | 4: 2.4 g<br>3: 1.6 g | 4: 58 g<br>3: 39 g | 12.1 g | 40.2 g |
| 4 | 4: 2.8 g<br>5: 1.2 g | 4: 0.7 g<br>5: 0.3 g | 4: 2.8 g<br>5: 1.2 g | 4: 68 g<br>5: 29 g | 12.1 g | 40.2 g |
| 5 | 4: 2.8 g<br>5: 0.8 g<br>3: 0.4 g | 4: 0.7 g<br>5: 0.2 g<br>3: 0.1 g | 4: 2.8 g<br>5: 0.8 g<br>3: 0.4 g | 4: 68 g<br>5: 19 g<br>3: 10 g | 12.1 g | 40.2 g |
| 6 | 1: 2.8 g<br>6: 1.2 g | 1: 2.0 g<br>6: 1.0 g | 1: 2.8 g<br>6: 1.2 g | 1: 68 g<br>6: 29 g | 17.0 g | 40.2 g |
| 7 | 7: 2.8 g<br>6: 1.2 g | 7: 2.0 g<br>6: 1.0 g | 7: 2.8 g<br>6: 1.2 g | 7: 68 g<br>6: 29 g | 15.0 g | 40.2 g |
| 8 | 4: 5.0 g | 4: 10.0 g | 4: 4.0 g | 4: 97 g | 25.0 g | 40.2 g |
| 9 | 1: 4.8 g<br>2: 0.2 g | 1: 9.5 g<br>2: 0.5 g | 1: 2.8 g<br>2: 1.2 g | 1: 92 g<br>2: 5 g | 20.0 g | 40.2 g |
| 10 | 3: 3.0 g<br>4: 2.0 g | 1, 2, 5, 6 and<br>7: 2.0 g each | 3: 2.4 g<br>4: 1.6 g | 3: 60 g<br>4: 37 g | 25.0 g | 40.2 g |

(Preparation of Toners 1 through 10)

Each of the above-prepared Colored resin particles 1 through 10 was mixed with 1% by weight of hydrophobic silica having a number average primary particle diameter of 12 nm and a hydrophobilized degree of 68 and hydrophobic titanium oxide having a number average primary particle diameter of 20 nm and a hydrophobilized degree of 63 by a Henschel mixer to prepare Toners for developing static latent image 1 through 10.

There was no difference between the properties such as the shape and the particle diameter of each of the colored resin particle and each of the toners.

(Preparation of Developer)

Each of the Toners 1 through 10 was mixed with silicone coated ferrite carrier having a volume average diameter of 60 μm so that the toner concentration was to be made to 6% to prepare Developers 1 through 10, respectively.

Thus obtained developers were each subjected to evaluation on the fogging and the transparency of OHP image by the following practical test.

(Evaluation of Fogging)

Digital copy machine SITIOS® 7075, manufactured by Konica Corp., was used for the evaluation. An image was continuously printed for 5,000 sheets under a high temperature and humidity condition of 33° C. and 80% RH and the power was off. After 72 hours, the printing was restarted and the printed images were observed one by one for counting the stain of the image or the fogging. The samples were classified into the following ranks.

A: Number of the fogging was from 0 to less than 4.

B: Number of the fogging was from 4 to less than 10.

C: Number of the fogging was 10 or more.

In the invention, it was judged that the sample having the number of the fogging of than 10 was acceptable for practical use.

(Evaluation of OHP Image)

A transparent image was prepared and evaluated by the following method. The image having an adhered toner amount 0.7±0.05 mg/cm$^2$ was evaluated. With respect to magenta toner, the difference between the visual spectral transmittance at 650 nm and that at 550 nm was calculated as the indicator of the OHP image. When the value was 70% or more, it can be judged that the transparency of the image was suitable.

A: 90% or more

B: 70 to less than 90%

C: Less than 70%

Thus obtained results are shown in Table 2.

TABLE 2

| Toner No. | Content in Toner: Particle (ppm by weight) | Compound of Formula 1: Compound A: Compound No. | Number of carbon atoms (N) | Content (%) | Compound B: Compound No. | Number of carbon atoms (N') | Difference between N and N' | Content (%) | Other Compound: Compound No. | Content (%) | Multi-valent metal | Fog | Transparency of OHP | Remarks |
|---|---|---|---|---|---|---|---|---|---|---|---|---|---|---|
| 1 | 980 | 1 | 8 | 85 | 2 | 9 | 1 | 15 | | | 3800 | B | 76 | Inv. |
| 2 | 570 | 2 | 9 | 53 | 3 | 11 | 2 | 47 | | | 220 | B | 71 | Inv. |
| 3 | 68 | 4 | 12 | 60 | 3 | 11 | 1 | 40 | | | 680 | A | 93 | Inv. |
| 4 | 70 | 4 | 12 | 70 | 5 | 13 | 1 | 30 | | | 700 | A | 98 | Inv. |
| 5 | 85 | 4 | 12 | 65 | 5 | 13 | 1 | 18 | 3 | 17 | 690 | A | 95 | Inv. |
| 6 | 350 | 1 | 8 | 70 | 6 | 12 | 3 | 30 | | | 2100 | B | 89 | Inv. |

TABLE 2-continued

| | | Compound of Formula 1 | | | | | | | | | | | | |
|---|---|---|---|---|---|---|---|---|---|---|---|---|---|---|
| | | Compound A | | | Compound B | | | | | | | | | |
| | Content in Toner | Number of | | | Number of | | | | Other Compound | | | | | |
| Toner No. | Particle (ppm by weight) | Compound No. | carbon atoms (N) | Content (%) | Compound No. | carbon atoms (N') | Difference between N and N' | Content (%) | Compound No. | Content (%) | Multivalent metal | Fog | Transparency of OHP | Remarks |
| 7 | 150 | 7 | 12 | 70 | 6 | 12 | 1 | 30 | | | 1200 | A | 94 | Inv. |
| 8 | 1400 | 4 | 12 | 100 | — | — | — | — | | | 5500 | C | 60 | Comp. |
| 9 | 1300 | 1 | 8 | 95 | 2 | 9 | 1 | 5 | | | 5600 | C | 65 | Comp. |
| 10 | 1500 | 3 | 11 | 45 | 4 | 12 | 1 | 30 | 1, 2, 5, 6, 7 | 5 in each | 5400 | C | 54 | Comp. |

Inv: Invention
Comp.: Comparative

It is clear form Table 2 that the samples according to the invention are low in the fogging and suitable in the OHP image transparency.

The toner for developing static charged giving low fogging and suitable OPH transparency, the method for producing the toner and the image forming method can be provided by the invention.

What is claimed is:

1. A toner for developing a static latent image comprising an external additive and colored resin particles containing a resin and a colorant, wherein the colored resin particles contain at least two kinds of compounds each represented by the following Formula, and total amount of the compounds is from 1 to 1,000 ppm by weight based on the total amount of the toner,

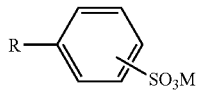

wherein, R is an aliphatic hydrocarbon group having from 6 to 22 carbon atoms, M is a monovalent metal atom.

2. The toner of claim 1, wherein the colored resin particle contains a first compound represented by the Formula from 50 to 90% by weight based on the whole amount of the compound represented by the Formula in the colored resin particle.

3. The toner of claim 2, wherein the colored resin particle contains the first compound represented by the Formula from 60 to 80% by weight of the whole amount of the compound represented by the Formula in the colored resin particle.

4. The toner of claim 2, wherein the colored resin particle contains a second compound represented by the Formula and the difference of carbon atoms between the first and the second compound is 1.

5. The toner of claim 4, having the colored resin particles such that at least 65 percent of the colored resin particles have a shape factor in the range of 1.0 to 1.6, in which the shape factor is represented by the formula: Shape factor $=\{(\text{maximum diameter}/2)^2\times\pi\}/\text{projected area}$.

6. The toner of claim 2, wherein the total amount of the compound represented by the Formula is from 7 to 100 ppm.

7. The toner of claim 2, wherein the amount of the compound represented by the Formula is from 5 to 500 ppm.

8. The toner of claim 1, wherein the compound is selected from the group consisting of:

n-$C_8H_{17}$—($C_6H_4$)—$SO_3Na$ (p),
n-$C_9H_{19}$—($C_6H_4$)—$SO_3Na$ (p),
n-$C_{11}H_{23}$—($C_6H_4$)—$SO_3Na$ (p),
n-$C_{12}H_{25}$—($C_6H_4$)—$SO_3Na$ (p),
n-$C_{13}H_{27}$—($C_6H_4$)—$SO_3Na$ (p),

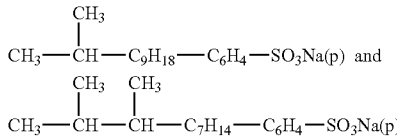

9. The toner of claim 1, wherein the total amount of the compound represented by the Formula is from 5 to 500 ppm.

10. The toner of claim 1, having the colored resin particles such that at least 65 percent of the colored resin particles have a shape factor in the range of 1.0 to 1.6, in which the shape factor is represented by the formula: Shape factor $=\{(\text{maximum diameter}/2)^2\times\pi\}/\text{projected area}$.

11. The toner of claim 1, wherein the total amount of the compound represented by the Formula in the toner is from 7 to 100 ppm.

12. A toner for developing a static latent image comprising an external additive and colored resin particles containing a resin and a colorant, wherein the colored resin particles contain at least two kinds of compounds each represented by the following Formula, and total amount of the compounds is from 1 to 1,000 ppm by weight based on the total amount of the toner,

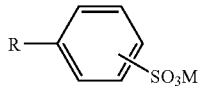

wherein, R is an aliphatic hydrocarbon group having from 6 to 22 carbon atoms, M is a monovalent metal atom, the compounds are added during the polymerization process of the resin for the colored resin particles.

13. The toner of claim 12, having the colored resin particles such that at least 65 percent of the colored resin particles have a shape factor in the range of 1.0 to 1.6, in which the shape factor isrepresented by the formula: Shape factor={(maximum diameter/2)$^2$×π}/projected area.

14. The toner of claim 12, wherein the colored resin particle contains a first compound represented by the Formula from 50 to 90% by weight based on the whole amount of the compound represented by the Formula in the colored resin particle.

15. The toner of claim 14, wherein the amount of the compound represented by the Formula is from 5 to 500 ppm.

16. The toner of claim 14, wherein the amount of the compound represented by the Formula is from 7 to 700 ppm.

17. The toner of claim 14, wherein the colored resin particle contains a second compound represented by the Formula and the difference of carbon atoms between the first and the second compound is 1.

18. The toner of claim 12, wherein the compound is selected from the group consisting of:

n-$C_8H_{17}$—($C_6H_4$)—$SO_3Na$ (p), n-$C_9H_{19}$—($C_6H_4$)—$SO_3Na$ (p), n-$C_{11}H_{23}$—($C_6H_4$)—$SO_3Na$ (p), n-$C_{12}H_{25}$—($C_6H_4$)—$SO_3Na$ (p), n-$C_{13}H_{27}$—($C_6H_4$)—$SO_3Na$ (p),

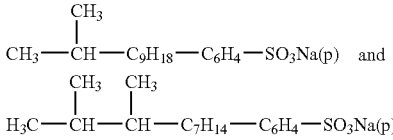

and

19. The toner of claim 12, wherein the total amount of the compound represented by the Formula in the toner is from 5 to 500 ppm.

20. The toner of claim 12, wherein the total amount of the compound represented by the Formula in the toner is from 7 to 100 ppm.

* * * * *